United States Patent [19]

Wittchow

[11] 4,271,792

[45] Jun. 9, 1981

[54] STEAM GENERATOR FOR GENERATING STEAM FROM FEEDWATER OF REDUCED QUALITY

[75] Inventor: Eberhard Wittchow, Erlangen, Fed. Rep. of Germany

[73] Assignee: Kraftwerk Union Aktiengesellschaft, Mülheim, Fed. Rep. of Germany

[21] Appl. No.: 87,878

[22] Filed: Oct. 24, 1979

[30] Foreign Application Priority Data

Oct. 31, 1978 [DE] Fed. Rep. of Germany ..... 2847340

[51] Int. Cl.[3] ..... F22D 7/00

[52] U.S. Cl. ..... 122/406 S; 122/451 S

[58] Field of Search ..... 122/406 R, 406 S, 406 ST, 122/451 S, 451 R

[56] References Cited

U.S. PATENT DOCUMENTS

| | | | |
|---|---|---|---|
| 1,579,773 | 4/1926 | Losel | 122/406 R |
| 2,741,228 | 4/1956 | Vorkane | 122/406 R |
| 3,213,835 | 10/1965 | Egglestone | 122/406 S |
| 3,344,777 | 10/1967 | Gorzegno | 122/406 S |
| 3,399,656 | 9/1968 | Strohmeyer | 122/406 S |

FOREIGN PATENT DOCUMENTS 435416 10/1926 Fed. Rep. of Germany ..... 122/406 R

*Primary Examiner*—Edward G. Favors

*Attorney, Agent, or Firm*—Herbert L. Lerner; Laurence A. Greenberg

[57] ABSTRACT

Steam generator for generating steam from feedwater of lower quality, having heating surfaces formed of tubes welded to one another directly or through bridges, a plurality of the tubes being connected in parallel in respective groups at the feedwater and steam sides of the generator including a first feedwater circulatory system with water of lower quality, a second feedwater circulatory system with water of higher quality, a first part of the group of tubes connected in parallel at the feedwater side of the generator being connected in the first feedwater circulatory system, and a second part of the group of tubes connected in parallel at the feedwater side of the generator being connected in the second feedwater circulatory system, the tubes of the second part of the group of tubes at the feedwater side being distributed between the tubes of the first part thereof.

2 Claims, 1 Drawing Figure

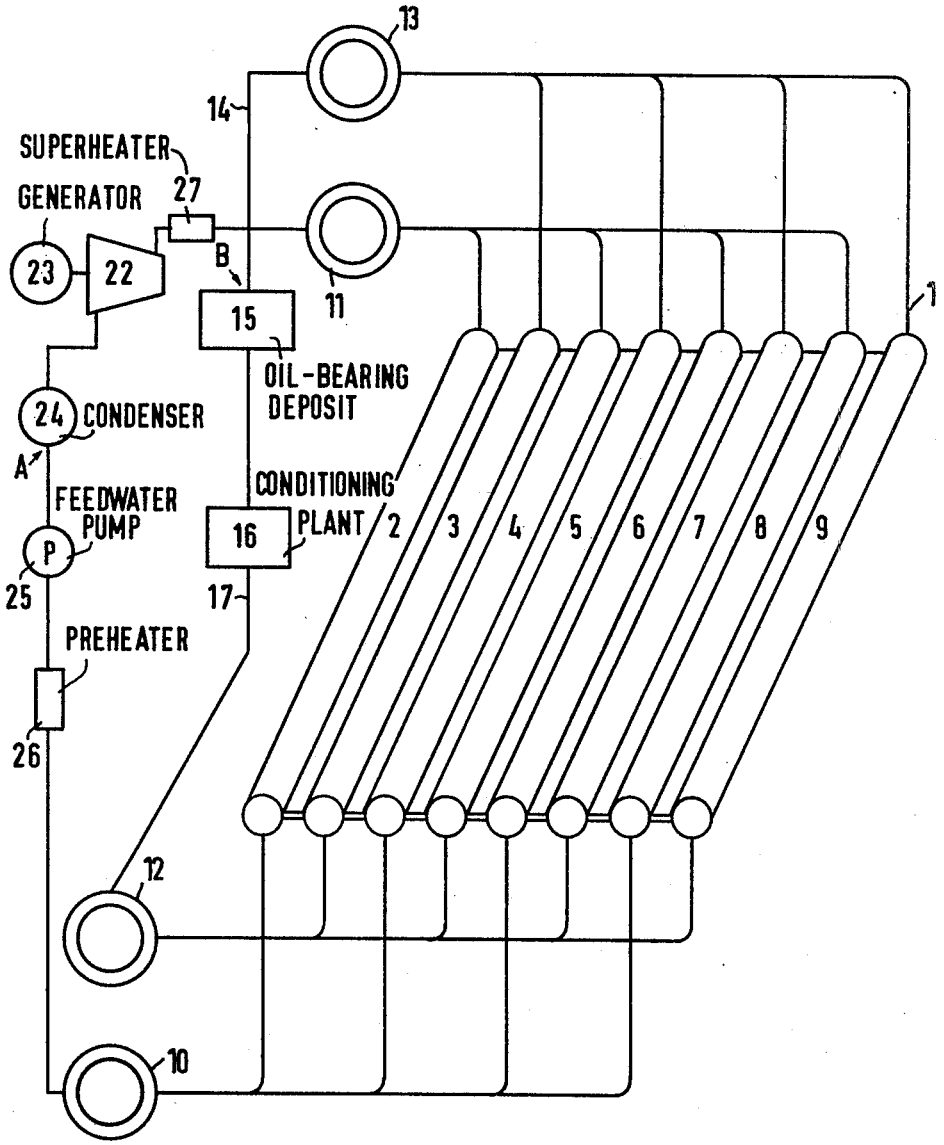
13
14
SUPERHEATER
GENERATOR
27
23
22
B
15
11
1
OIL-BEARING
DEPOSIT
24
CONDENSER
A
CONDITIONING
FEEDWATER
PUMP
PLANT
16
2
3
4
5
6
7
8
9
P
25
17
PREHEATER
26
12
10

STEAM GENERATOR FOR GENERATING STEAM FROM FEEDWATER OF REDUCED QUALITY

The invention relates to a steam generator for generating steam, having heating surfaces formed of tubes welded to one another directly or through bridges or bars, a respective plurality of the tubes thereof being connected in parallel at the feedwater and steam sides of the generator.

To generate steam for electric power plants, once-through steam generators are used, in many cases, wherein the walls and the heating surfaces of the steam generator are formed of tubes which are welded to one another. Such tube walls are formed either of mutually welded finned tubes or of mutually welded tube-bar-tube construction. The tube walls are installed both as radiant heating surfaces of a combustion chamber as well as contact heating surfaces in the flue gas pass of a steam generator.

To ensure trouble-free operation, the steam generator is supplied with feedwater which is purified in high quality feedwater preparation or conditioning plants so that it is free of additives, salts and dirt particles. Such a prepared feedwater prevents corrosion and deposits in the tubes and ensures a uniformly low resistivity to heat passage.

At present, steam generated in a steam generator is not only necessary for producing electricity, but also for the chemical industry or even for steam injection into oil-bearing deposits so as to release oil from oil sand or oil shale. In this connection, the steam is mixed with other chemical products, and the re-use of the condensate requires costly feedwater preparation or conditioning plants which increase the cost of the generated steam.

It is accordingly an object of the invention to provide a steam generator which can also generate steam from feedwater of lower quality without markedly diminishing the operational reliability or safety of the steam generator due to danger of overheating of individual tubes.

With the foregoing and other objects in view, there is provided, in accordance with the invention, a steam generator for generating steam from feedwater of lower quality, having heating surfaces formed of tubes welded to one another directly or through bridges, a plurality of the tubes being connected in parallel in respective groups at the feedwater and steam sides of the generator comprising a first feedwater circulatory system with water of lower quality, a second feedwater circulatory system with water of higher quality, a first part of the group of tubes connected in parallel at the feedwater side of the generator being connected in the first feedwater circulatory system, and a second part of the group of tubes connected in parallel at the feedwater side of the generator being connected in the second feedwater circulatory system, the tubes of the second part of the group of tubes at the feedwater side being distributed between the tubes of the first part thereof.

In accordance with another feature of the invention, the tubes of the heating surfaces are alternatingly connected to a respective manifold of the feedwater circulatory system with water of lower quality and of the feedwater circulatory system with water of higher quality.

Other features which are considered as characteristic for the invention are set forth in the appended claims.

Although the invention is illustrated and described herein as embodied in steam generator for generating steam from feedwater of reduced quality, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic, partly perspective and partly schematic view of part of the steam generator according to the invention.

Referring now to the drawing, there is shown therein a tube wall of the steam generator which suffices for illustrating the principle of the invention of the instant application. The tube wall is formed of eight tubes 2 to 9 welded to one another through the intermediary of bridges or bars 1, the tubes identified by even reference numerals, being connected to a feedwater distributor manifold 10 and to a steam collector or manifold 11, while the tubes identified by odd reference numerals are connected to a feedwater distributor manifold 12 and a steam collector or manifold 13.

The feedwater distributor 10, the even-numbered steam-generator tubes and the steam collector 11 form part of a feedwater circulatory system A, for example, in which there are serially connected, in a conventional manner, a superheater 27, a turbine 22 for generating electric power in a generator 23, a condenser 24, a feedwater pump 25, a preheater 16 back to the feedwater distributor 10. The feedwater distributor 12 and the steam collector or accumulator 13 form part of a second feedwater circulatory system B wherein a steam line 14 extends from the steam collector 13 into a deposit 15 of oil sand or oil shale and from there into a conditioning or preparation plant 16 for separating the hydrocarbon-containing products, and from the plant 16 through a water return line 17 back to the feedwater distributor 12.

In order to keep the steam from becoming too expensive, a costly feedwater conditioning or preparation plant is omitted from the second feedwater circulatory system B, so that sedimentation or deposits can indeed occur in the odd-numbered steam-generator tubes of the illustrated tube wall. A consequence thereof is that the temperature of the even-numbered steam-generator tubes becomes higher than the temperature of the intermediately disposed odd-numbered steam-generator tubes in the steam generator. As a condition of the good thermal conductivity between adjacent steam generator tubes, however, this temperature difference remains within limits so that, in this manner, feedwater of low quality can also be vaporized readily in the steam generator.

In the illustrated embodiment, every second tube is connected to the feedwater circulatory system A of relatively high quality. Instead of the ratio 1:1 selected for the embodiment described hereinbefore, there may likewise be provided a ratio 2:1 or 1:2 or even a different ratio for the division of the first part and of the second part of the steam generator tubes 2 to 9 which are connected in parallel with one another.

There is claimed:

1. Steam generator for generating steam from feedwater of lower quality, having heating surfaces formed of tubes welded to one another directly or through bridges, a plurality of the tubes being connected in parallel in respective groups at the feedwater and steam sides of the generator comprising a first feedwater circulatory system with water of lower quality, a second feedwater circulatory system with water of higher quality, a first part of the group of tubes connected in parallel at the feedwater side of the generator being connected in said first feedwater circulatory system, and a second part of the group of tubes connected in parallel at the feedwater side of the generator being connected in said second feedwater circulatory system, the tubes of the second part of said group of tubes at the feedwater side being distributed between the tubes of the first part thereof.

2. Steam generator according to claim 1 wherein the tubes of the heating surfaces are alternatingly connected to a respective manifold of the feedwater circulatory system with water of lower quality, and of the feedwater circulatory system with water of higher quality.

* * * * *